US009709059B2

(12) United States Patent
Liang

(10) Patent No.: US 9,709,059 B2
(45) Date of Patent: Jul. 18, 2017

(54) CROSS-FLOW WAVE MAKING PUMP

(71) Applicant: Guangzhou Maiguang Electronic Science Technology Co., Ltd., Guangzhou, Guangdong (CN)

(72) Inventor: Weixin Liang, Guangzhou (CN)

(73) Assignee: Guangzhou Maiguang Electronic Science Technology Co., Ltd. (CN)

( * ) Notice: Subject to any disclaimer, the term of this patent is extended or adjusted under 35 U.S.C. 154(b) by 378 days.

(21) Appl. No.: 14/358,739

(22) PCT Filed: Apr. 11, 2014

(86) PCT No.: PCT/CN2014/075205
§ 371 (c)(1),
(2) Date: May 16, 2014

(87) PCT Pub. No.: WO2015/149383
PCT Pub. Date: Oct. 8, 2015

(65) Prior Publication Data

US 2015/0292507 A1 Oct. 15, 2015
US 2016/0305432 A2 Oct. 20, 2016

(30) Foreign Application Priority Data

Apr. 2, 2014 (CN) ..... 2014 2 0159547 U

(51) Int. Cl.
*F04D 13/12* (2006.01)
*F04D 29/22* (2006.01)
(Continued)

(52) U.S. Cl.
CPC ..... *F04D 13/02* (2013.01); *F04D 1/00* (2013.01); *F04D 1/12* (2013.01); *F04D 17/04* (2013.01);
(Continued)

(58) Field of Classification Search
CPC ..... F04D 29/22; F04D 1/00; F04D 17/04
(Continued)

(56) References Cited

U.S. PATENT DOCUMENTS 3,940,215 A 2/1976 Hori
6,217,541 B1 4/2001 Yu
(Continued)

FOREIGN PATENT DOCUMENTS

CN 101793255 A 8/2010
GB 983901 2/1965

OTHER PUBLICATIONS

Translation of CN 101793255.*

*Primary Examiner* — Kevin Murphy
*Assistant Examiner* — Kelsey Rohman
(74) *Attorney, Agent, or Firm* — James A. Sheridan; Sheridan Law, LLC

(57) ABSTRACT

This invention relates to a cross-flow wave making pump comprising an impeller shell forming a water intake and a water outlet, an impeller assembly pivotally connected to two ends of the impeller shell, and a motor used for driving the impeller assembly; wherein, the impeller assembly comprises an impeller used for driving a liquid flow, a first turntable and a second turntable respectively fixed at two ends of the impeller, wherein the first turntable is provided with a shaft rotatably mounted in the impeller shell, the second turntable is provided with a cavity used for receiving a rotor shaft of the motor. The embodiments of the present invention can provide a sufficient liquid-circulation in a container, and significantly reduce the dead zone where the liquid flows extremely slowly.

19 Claims, 3 Drawing Sheets

(51) Int. Cl.

| | |
|---|---|
| ***F04D 1/00*** | (2006.01) |
| ***F04D 17/04*** | (2006.01) |
| ***F04D 1/12*** | (2006.01) |
| ***F04D 29/043*** | (2006.01) |
| ***F04D 29/049*** | (2006.01) |
| ***F04D 29/42*** | (2006.01) |
| ***F04D 29/44*** | (2006.01) |
| ***F04D 13/02*** | (2006.01) |

(52) U.S. Cl.
CPC ..... *F04D 29/043* (2013.01); *F04D 29/049* (2013.01); *F04D 29/22* (2013.01); *F04D 29/4293* (2013.01); *F04D 29/445* (2013.01)

(58) Field of Classification Search
USPC ..... 416/178, 184; 415/53.1, 53.2, 53.3
See application file for complete search history.

(56) References Cited

U.S. PATENT DOCUMENTS

| | | | | |
|---|---|---|---|---|
| 2003/0202880 | A1* | 10/2003 | Koochingchai | F04D 25/166 415/229 |
| 2006/0172682 | A1* | 8/2006 | Orr | F04D 17/04 454/152 |
| 2007/0252460 | A1* | 11/2007 | Cheng | F04D 17/04 310/90 |
| 2009/0067982 | A1* | 3/2009 | Ko | F04D 29/668 415/53.1 |
| 2010/0158664 | A1 | 6/2010 | Ko | |
| 2012/0219434 | A1* | 8/2012 | Tai | F04D 25/10 417/234 |

* cited by examiner

CROSS-FLOW WAVE MAKING PUMP

FIELD OF THE INVENTION

This invention relates to a wave making pump, especially to a cross-flow wave making pump that can provide a sufficient liquid-circulation in a container.

BACKGROUND OF THE INVENTION

In most cases, existing wave making pumps use inner rotor brushless motor with propeller-type axial vanes to drive a liquid flow, or use inner rotor brushless motor with centrifugal vanes to swallow and extrude liquid so as to force the liquid to flow. The inner rotor brushless motor is characterized by high rotation speed but low torque, so it can only drive small-sized vanes, moreover, the outlet area of this kind of wave making pumps is relatively small, when a high flow velocity is required, it needs to increase the rotation speed to increase the flow rate. Therefore, when this kind of wave making pump is applied to making liquid circulation or making waves, it's likely to cause uneven flow or insufficient liquid-circulation, and form, in the container, dead zones where the liquid flows extremely slowly.

SUMMARY OF THE INVENTION

To overcome the defects in the prior art, the present invention provides a cross-flow wave making pump which can provide a sufficient liquid-circulation in a container, and significantly reduce the dead zone where the liquid flows extremely slowly.

To achieve the above goals, the present invention provides the following technical solution.

The present invention provides a cross-flow wave making pump comprising an impeller shell forming a water intake and a water outlet, an impeller assembly pivotally connected to two ends of the impeller shell, and a motor used for driving the impeller assembly.

Wherein the impeller assembly comprises an impeller used for driving a liquid flow, a first turntable and a second turntable respectively fixed at two ends of the impeller, wherein the first turntable is provided with a shaft rotatably mounted in the impeller shell, the second turntable is provided with a cavity used for receiving a rotor shaft of the motor.

Preferably, the cross-flow wave making pump has two impeller assemblies and two impeller shells, each side of the motor is provided with one impeller assembly and one impeller shell.

Preferably, the impeller comprises a first vane and a second vane, a third turntable is located between the first turntable and the second turntable, the first vane is fixed between the first turntable and the third turntable, the second vane is fixed between the second turntable and the third turntable; a plurality of the first vanes are circumferentially arranged along an axis of the first turntable, and a plurality of the second vanes are circumferentially arranged along an axis of the second turntable.

Preferably, the impeller shell comprises a first sleeve and a second sleeve that are disposed parallel to each other and are connected by an arc-shaped shell, the second sleeve sleeves a stator of the motor, a flow-guiding plate is provided above the arc-shaped shell.

Preferably, the first sleeve is clamped with an end cover, the end cover is inserted with a bushing rubber pad, the bushing rubber pad is inserted with a bushing, and the bushing is rotatably inserted with the shaft.

Preferably, the impeller shell further comprises a tongue piece crossing between the first sleeve and the second sleeve and connecting the first sleeve and the second sleeve, a space between the tongue piece and the flow-guiding plate forms the water outlet, a space between the tongue piece and a lower side of the arc-shaped shell forms the water intake.

Preferably, the tongue piece comprises a first tongue piece and a second tongue piece that are disposed parallel to each other, one side of the first tongue piece is connected to a same side of the second tongue piece by a vertically fixed third tongue piece, a plurality of reinforcing ribs are fixed between the first tongue piece and the second tongue piece.

Preferably, the cavity is inserted with a soft rubber pad, and the rotor shaft of the motor is inserted in the soft rubber pad.

Preferably, the shaft is a ceramic shaft.

Preferably, the motor is an outer rotor motor.

The beneficial effects of the cross-flow wave making pump of the present invention are as follows.

The cross-flow wave making pump of the present invention drives the impeller assembly pivotally connected to the two ends of the impeller shell by the motor, so as to force the liquid to circulate, wherein the impeller assembly comprises the impeller used for driving a liquid flow, the first turntable and the second turntable respectively fixed at the two ends of the impeller, wherein the first turntable is provided with the shaft rotatably mounted in the impeller shell, the second turntable is provided with the cavity used for receiving the rotor shaft of the motor. By rotating the impeller assembly, the cross-flow wave making pump of the present invention creates a sufficient liquid-circulation in the container, which significantly reduces the dead zone where the liquid flows extremely slowly; furthermore, the cross-flow wave making pump has two impeller assemblies and two impeller shells, each side of the motor is provided with one impeller assembly and one impeller shell, in this way, the cross-flow wave making pump of the present invention makes a further contribution to the liquid-circulation. In addition, the motor is an outer rotor motor, such that the impeller assemblies can obtain a relatively high torque. Therefore, the motor can drive a big-sized strip-shaped impeller so as to overcome the defect that the torque of an inner motor brushless motor is relatively small.

LIST OF REFERENCE NUMERALS OF MAIN COMPONENTS

Figure 1:
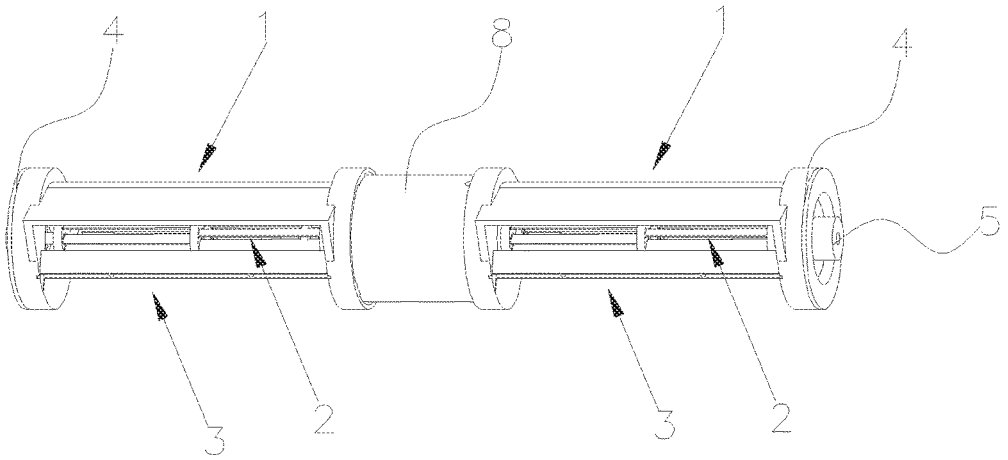
FIG. 1 is a schematic structural diagram of a cross-flow wave making pump of the present invention.

1 impeller shell
11 first sleeve
12 second sleeve
13 arc-shaped shell
14 flow-guiding plate

2 impeller assembly
21 shaft
22 first turntable
23 third turntable
24 second turntable
25 first vane
26 second vane
27 cavity
3 tongue piece
31 first tongue piece
32 second tongue piece
33 third tongue piece
34 reinforcing rib
4 end cover
5 bushing rubber pad
6 bushing
7 soft rubber pad
8 motor
81 rotor shaft

DETAILED DESCRIPTION OF ILLUSTRATED EMBODIMENTS

Various preferred embodiments will now be described with reference to the figures.

Figure 2:
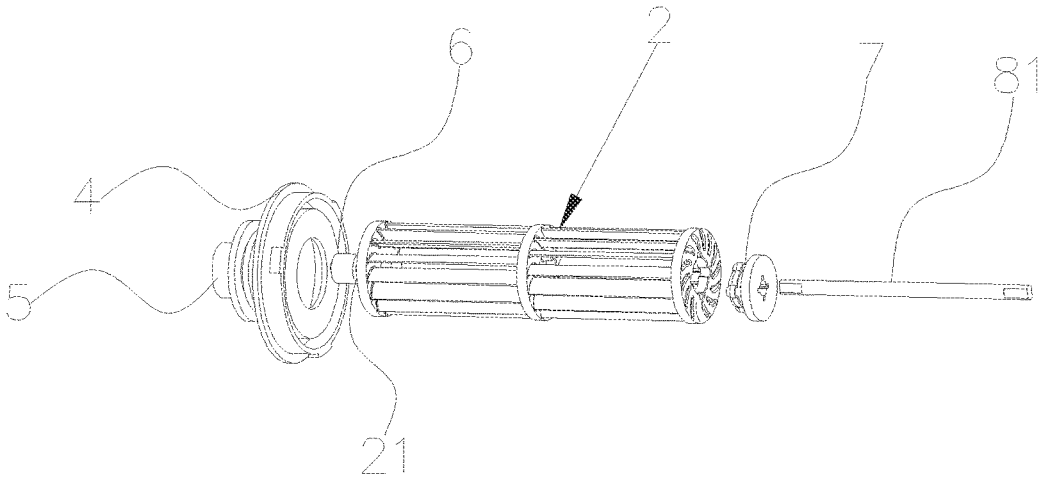
FIG. 2 is a schematic structural diagram of a part of a cross-flow wave making pump of the present invention.
Figure 3:
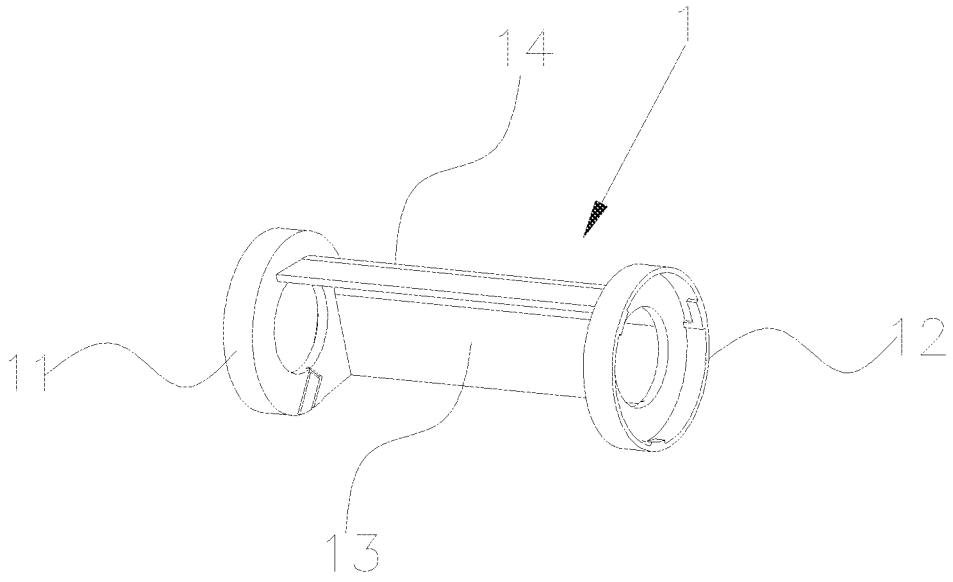
FIG. 3 is a schematic structural diagram of an impeller shell of the present invention.
Figure 4:
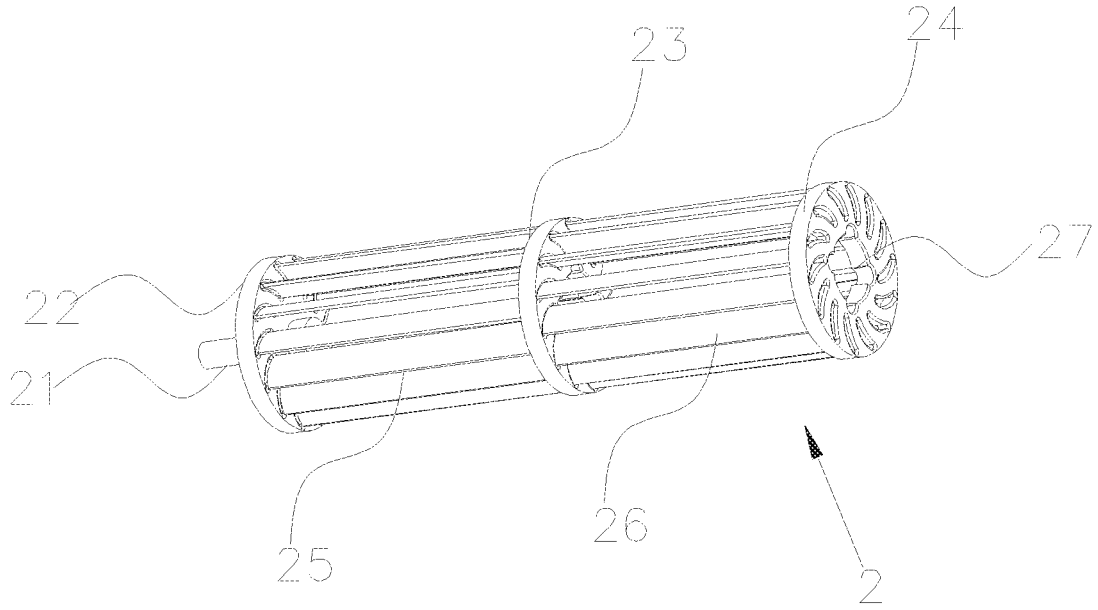
FIG. 4 is a schematic structural diagram of an impeller assembly of the present invention.
Figure 5:
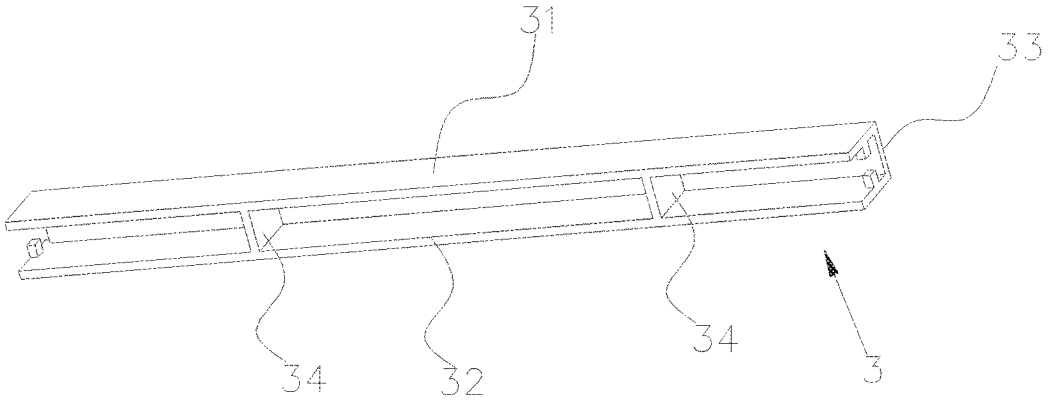
FIG. 5 is a schematic structural diagram of a tongue piece of the present invention.

As shown in FIG. 1-FIG. 5, a cross-flow wave making pump of the present invention comprises an impeller shell 1 forming a water intake and a water outlet, an impeller assembly 2 pivotally connected to two ends of the impeller shell 1, and a motor 8 used for driving the impeller assembly 2.

Wherein the impeller assembly 2 comprises an impeller used for driving a liquid flow, a first turntable 22 and a second turntable 24 respectively fixed at two ends of the impeller, wherein the first turntable 22 is provided with a shaft 21 rotatably mounted in the impeller shell 1, the second turntable 24 is provided with a cavity 27 used for receiving a rotor shaft 81 of the motor 8.

The cross-flow wave making pump of the present invention drives the impeller assembly 2 pivotally connected to the two ends of the impeller shell 1 by the motor 8, so as to force the liquid to circulate. By rotating the impeller assembly 2, the cross-flow wave making pump of the present invention makes a sufficient liquid-circulation in the container, and hence significantly reduce the dead zone where the liquid flows extremely slowly.

Preferably, the cross-flow wave making pump has two impeller assemblies 2 and two impeller shells 1, each side of the motor 8 is provided with one impeller assembly 2 and one impeller shell 1. In this way, the cross-flow wave making pump of the present invention makes a further contribution to the liquid-circulation in the container.

Preferably, the impeller comprises a first vane 25 and a second vane 26, a third turntable 23 is located between the first turntable 22 and the second turntable 24, the first vane 25 is fixed between the first turntable 22 and the third turntable 23, the second vane 26 is fixed between the second turntable 24 and third turntable 23; a plurality of the first vanes 25 are circumferentially arranged along an axis of the first turntable 22, and a plurality of the second vanes 26 are circumferentially arranged along an axis of the second turntable 24. In this way, the wave making pump can drive an increased amount of liquid, so as to further reduce the dead zone where the liquid flows extremely slowly.

In addition, the number of the first vane 25 and the second vane 26 can be adjusted, which depends on the size of the container, the volume of the liquid, the properties of the liquid and other actual conditions.

Preferably, the impeller shell 1 comprises a first sleeve 11 and a second sleeve 12 that are disposed parallel to each other and are connected by an arc-shaped shell 13, the second sleeve 12 sleeves a stator of the motor 8, a flow-guiding plate 14 is provided above the arc-shaped shell 13. With the help of the flow-guiding plate 14, the direction of the liquid flow can be effectively guided.

Preferably, the first sleeve 11 is clamped with an end cover 4, the end cover 4 is inserted with a bushing rubber pad 5, the bushing rubber pad 5 is inserted with a bushing 6, and the bushing 6 is rotatably inserted with the shaft 21. Owning to the bushing rubber pad 5 and the bushing 6, the abrasions of the shaft 21 and the end cover 4 are significantly reduced, which effectively extends the service life of the shaft 21.

Preferably, the impeller shell 1 further comprises a tongue piece 3 crossing between the first sleeve 11 and the second sleeve 12 and connecting the first sleeve 11 and the second sleeve 12, a space between the tongue piece 3 and the flow-guiding plate 14 forms the water outlet, a space between the tongue piece 3 and a lower side of the arc-shaped shell 13 forms the water intake. By setting the tongue piece 3, the liquid in the container can form an inflow-outflow circulation at the impeller assembly 2.

In addition, in another embodiment of the present invention, it's the space between the tongue piece 3 and the flow-guiding plate 14 that forms the intake, and the space between the tongue piece 3 and the lower side of the arc-shaped shell 13 that forms the outlet.

Preferably, the tongue piece 3 comprises a first tongue piece 31 and a second tongue piece 32 that are disposed parallel to each other, one side of the first tongue piece 31 is connected to a same side of the second tongue piece 32 by a vertically fixed third tongue piece 33, a plurality of reinforcing ribs 34 are fixed between the first tongue piece 31 and the second tongue piece 32.

Preferably, a soft rubber pad 7 is inserted in the cavity 27, the rotor shaft 81 of the motor 8 is inserted in the soft rubber pad 7. Owning to the soft rubber pad 7, the abrasion of rotor shaft 81 of the motor 8 is significantly reduced, which effectively extends the service life of the rotor shaft 81 of the motor 8.

Preferably, the shaft 21 is a ceramic shaft. Since the ceramic shaft is characterized by high strength, high heat resistance, high abrasion resistance, high corrosion resistance, high insulation, etc, the ceramic shaft can be taken as a preferred embodiment of the shaft 21 in the present invention.

Preferably, the motor 8 is an outer rotor motor, so that the impeller assembly 2 can obtain a relatively high torque and the motor 8 can thus drive a big-sized strip-shaped impeller, which overcomes the defect that the torque of the traditional inner rotor brushless motor is relatively small.

The first vane 25 and the second vane 26 of the present invention are fixed to the impeller shell 1 by ultrasonic welding.

After assembling the pump as described above, when powering up the motor 8, the rotor and the rotor shaft 81 of the motor 8 will rotate continuously, the rotor shaft 81 of the motor 8 then drives the first vanes 25 and the second vanes 26 to rotate. With the participation of the impeller shell 1 and the tongue piece 3, a static pressure difference is formed in the impeller, the space between the tongue piece 3 and the flow-guiding plate 14 forms the water outlet, the space between the tongue piece 3 and the lower side of the arc-shaped shell 13 forms the water intake, so that the liquid will continuously flow through the impeller. Compared with the traditional wave making pump which requires high flow velocity and high hydraulic head during application, the cross-flow wave making pump of the present invention can create a sufficient liquid-circulation in a container and thus significantly reduce the dead zone where the liquid flows extremely slowly.

The foregoing descriptions are merely specific embodiments of the present invention, but are not intended to limit the protection scope of the present invention. Any variation or replacement readily figured out by persons skilled in the art within the technical scope disclosed in the present invention shall all fall within the protection scope of the present invention.

What is claimed is:

1. A cross-flow wave making pump, comprising:

an elongated impeller shell comprising a top longitudinal edge and a bottom longitudinal edge, wherein:

an arcuate wall extends between the top longitudinal edge and the bottom longitudinal edge, a center point of the arcuate wall defines a longitudinal rotational axis of the pump, an apex of the arcuate wall and the longitudinal rotational axis define a perpendicular axis that extends from the apex of the arcuate wall in an outward direction, and the arcuate wall is open toward the outward direction, a flow-guiding plate disposed adjacent to the top longitudinal edge of the impeller shell, a tongue piece disposed between the flow-guiding plate and the bottom longitudinal edge of the impeller shell, wherein a space between the tongue piece and the bottom longitudinal edge of the impeller shell forms a water inlet and a space between the tongue piece and the flow-guiding plate forms a water outlet, and wherein the water inlet and the water outlet face the outward direction, an impeller assembly pivotally connected to two ends of the impeller shell, and a motor for driving the impeller assembly; wherein, the impeller assembly comprises an impeller for driving a water flow, the motor having a water-tight configuration to drive water flow with the impeller assembly out of the water outlet from the water intake so as to provide a pump for making a cross-flow wave, characterized in that, the cross-flow wave making pump has two impeller assemblies and two impeller shells, and each side of the motor is provided with one impeller assembly and one impeller shell.

2. The cross-flow wave making pump as claimed in claim 1, characterized in that, the impeller comprises a first vane and a second vane.

3. The cross-flow wave making pump as claimed in claim 1, characterized in that, a soft rubber pad is positioned within a cavity formed in the impeller shell, and a rotor shaft of the motor is inserted in the soft rubber pad.

4. The cross-flow wave making pump as claimed in claim 3, characterized in that, the shaft is a ceramic shaft.

5. The cross-flow wave making pump as claimed in claim 1, characterized in that, the motor is an outer rotor motor.

6. A cross-flow wave making pump, comprising:

an elongated impeller shell comprising a top longitudinal edge and a bottom longitudinal edge, wherein:

an arcuate wall extends between the top longitudinal edge and the bottom longitudinal edge, a center point of the arcuate wall defines a longitudinal rotational axis of the pump, an apex of the arcuate wall and the longitudinal rotational axis define a perpendicular axis that extends from the apex of the arcuate wall in an outward direction, and the arcuate wall is open toward the outward direction, a flow-guiding plate disposed adjacent to the top longitudinal edge of the impeller shell, a tongue piece disposed between the flow-guiding plate and the bottom longitudinal edge of the impeller shell, wherein a space between the tongue piece and the bottom longitudinal edge of the impeller shell forms a water inlet and a space between the tongue piece and the flow-guiding plate forms a water outlet, and wherein the water inlet and the water outlet face the outward direction, an impeller assembly pivotally connected to two ends of the impeller shell, and a motor for driving the impeller assembly; wherein, the impeller assembly comprises an impeller for driving a water flow, the motor having a water-tight configuration to drive water flow with the impeller assembly out of the water outlet from the water intake so as to provide a pump for making a cross-flow wave, characterized in that, the impeller shell comprises a first sleeve and a second sleeve that are disposed parallel to each other and are connected by the arcuate wall, and the second sleeve sleeves a stator of the motor.

7. The cross-flow wave making pump as claimed in claim 6, characterized in that, the first sleeve is clamped with an end cover, the end cover is inserted with a bushing rubber pad, the bushing rubber pad is inserted with a bushing, the bushing is rotatably inserted with a shaft.

8. The cross-flow wave making pump as claimed in claim 6, characterized in that, the tongue piece crosses between the first sleeve and the second sleeve and connects the first sleeve and the second sleeve.

9. The cross-flow wave making pump as claimed in claim 8, characterized in that, the tongue piece comprises a first tongue piece and a second tongue piece that are disposed parallel to each other, one side of the first tongue piece is connected to a same side of the second tongue piece by a vertically fixed third tongue piece, a plurality of reinforcing ribs are fixed between the first tongue piece and the second tongue piece.

10. The cross-flow wave making pump as claimed in claim 6, characterized in that, the impeller comprises a first vane and a second vane.

11. The cross-flow wave making pump as claimed in claim 6, characterized in that, a soft rubber pad is positioned within a cavity formed in the impeller shell, and a rotor shaft of the motor is inserted in the soft rubber pad.

12. The cross-flow wave making pump as claimed in claim 11, characterized in that, the rotor shaft is a ceramic shaft.

13. The cross-flow wave making pump as claimed in claim 6, characterized in that, the motor is an outer rotor motor.

14. A system for providing water circulation in a container, the system comprising:

a volume of water having properties to allow wave motion therein;

a container having a base and sidewalls configured to hold the volume of the water; and a cross-flow wave making pump, comprising:

an elongated impeller shell having a top longitudinal edge and a bottom longitudinal edge, an arcuate wall extending between the top and the bottom longitudinal edges, a center point of the arcuate wall defining a longitudinal rotational axis of the pump, an apex of the arcuate wall and the longitudinal rotational axis defining a perpendicular axis that extends from the apex of the arcuate wall in an outward direction, and the arcuate wall open toward the outward direction, a flow-guiding plate disposed adjacent to the top longitudinal edge of the impeller shell, a tongue piece disposed between the flow-guiding plate and the bottom longitudinal edge of the impeller shell, wherein a space between the tongue piece and the bottom longitudinal edge of the impeller shell forms a water inlet and a space between the tongue piece and the flow-guiding plate forms a water outlet, and wherein the water inlet and the water outlet face the outward direction, an impeller assembly pivotally connected to two ends of the impeller shell, and a motor used for driving the impeller assembly, wherein the impeller assembly comprises an impeller used for driving a flow out of the water outlet from the water intake so as to provide a pump for making a cross-flow wave, characterized in that, the cross-flow wave making pump has two impeller assemblies and two impeller shells, and each side of the motor is provided with one impeller assembly and one impeller shell.

15. The system for providing liquid circulation in a container as claimed in claim 14, characterized in that, the impeller comprises a first vane and a second vane.

16. The system for providing liquid circulation in a container as claimed in claim 14, characterized in that, the motor is an outer rotor motor.

17. A system for providing water circulation in a container, the system comprising:

a volume of water having properties to allow wave motion therein;

a container having a base and sidewalls configured to hold the volume of the water; and a cross-flow wave making pump, comprising:

an elongated impeller shell having a top longitudinal edge and a bottom longitudinal edge, an arcuate wall extending between the top and the bottom longitudinal edges, a center point of the arcuate wall defining a longitudinal rotational axis of the pump, an apex of the arcuate wall and the longitudinal rotational axis defining a perpendicular axis that extends from the apex of the arcuate wall in an outward direction, and the arcuate wall open toward the outward direction, a flow-guiding plate disposed adjacent to the top longitudinal edge of the impeller shell, a tongue piece disposed between the flow-guiding plate and the bottom longitudinal edge of the impeller shell, wherein a space between the tongue piece and the bottom longitudinal edge of the impeller shell forms a water inlet and a space between the tongue piece and the flow-guiding plate forms a water outlet, and wherein the water inlet and the water outlet face the outward direction, an impeller assembly pivotally connected to two ends of the impeller shell, and a motor used for driving the impeller assembly, wherein the impeller assembly comprises an impeller used for driving a flow out of the water outlet from the water intake so as to provide a pump for making a cross-flow wave, characterized in that, the impeller shell comprises a first sleeve and a second sleeve that are disposed parallel to each other and are connected by the arcuate wall, and the second sleeve sleeves a stator of the motor.

18. The system for providing liquid circulation in a container as claimed in claim 17, characterized in that, the impeller comprises a first vane and a second vane.

19. The system for providing liquid circulation in a container as claimed in claim 17, characterized in that, the motor is an outer rotor motor.

* * * * *